US007150659B2

(12) United States Patent
Kotilainen et al.

(10) Patent No.: US 7,150,659 B2
(45) Date of Patent: Dec. 19, 2006

(54) METHOD FOR ELECTRICALLY CONTACTING A CABLE, CABLE CONNECTOR AND CONNECTOR TERMINAL BLOCK

(75) Inventors: Sami Kotilainen, Brugg (CH); Christian Ohler, Baden (CH)

(73) Assignee: ABB Research Ltd, Zurich (CH)

( * ) Notice: Subject to any disclaimer, the term of this patent is extended or adjusted under 35 U.S.C. 154(b) by 0 days.

(21) Appl. No.: 10/986,200

(22) Filed: Nov. 12, 2004

(65) Prior Publication Data

US 2005/0136752 A1 Jun. 23, 2005

(30) Foreign Application Priority Data

Dec. 18, 2003 (EP) ..... 03405905

(51) Int. Cl.
*H01R 4/48* (2006.01)

(52) U.S. Cl. ..... 439/835; 439/409

(58) Field of Classification Search ..... 439/387, 439/395, 409, 417, 441, 835
See application file for complete search history.

(56) References Cited

U.S. PATENT DOCUMENTS 2,609,415 A * 9/1952 Benander et al. ..... 439/409
3,119,647 A * 1/1964 Flagg ..... 439/441
3,474,389 A * 10/1969 Nagano ..... 439/440
3,877,774 A * 4/1975 Dorrell ..... 439/409
5,376,025 A * 12/1994 Willnat et al. ..... 439/817
5,449,300 A * 9/1995 Yoon ..... 439/441
5,961,344 A * 10/1999 Rosales et al. ..... 439/495
6,183,288 B1 2/2001 Barrat et al.
6,312,280 B1 * 11/2001 Stevenson ..... 439/393
6,527,580 B1 3/2003 Suss et al.
2003/0176098 A1 9/2003 Brandl et al.
2005/0136752 A1 * 6/2005 Kotilainen et al. ..... 439/835

FOREIGN PATENT DOCUMENTS

DE 196 04 615 C1 6/1997
DE 198 35 459 A1 2/2000

* cited by examiner

*Primary Examiner*—James R. Harvey
(74) *Attorney, Agent, or Firm*—Buchanan Ingersoll & Rooney PC

(57) ABSTRACT

The cable connector for making an electrical contact with a cable (1) having a cable conductor (2), comprises a guiding means (4) for receiving one end (1*a*) of the cable (1) in an initial state (O), a contact element (6) for electrically contacting the cable conductor (2) in a final state, and a holding means (18) for holding the cable (1) in electrical contact with the contact element (6) in the final state, wherein the guiding means (4) and the contact element (6) are moveable relative to each other, allowing for movements between the initial state (O) and the final state. A spring device (7) is provided, which is arranged such that it exerts a force against the movement from the initial state (O) to the final state, and which moves the cable (1) towards the initial state (O) if the cable is not in the final state. A contact ensuring mechanism (8) can be provided, which in the final state reduces the force exerted by the spring device (7) against the movement from the initial state (O) to the final state. The cable connector can, e.g., be used as an insulation displacement connector and in connector terminal blocks.

12 Claims, 4 Drawing Sheets

METHOD FOR ELECTRICALLY CONTACTING A CABLE, CABLE CONNECTOR AND CONNECTOR TERMINAL BLOCK

FIELD OF THE INVENTION

The invention relates to the field of low-voltage electrical cable connections and cable connectors, and in particular to connector terminals, insulation displacement connectors and connector terminal blocks. It relates to a method and apparatusses according to the opening clause of the claims. Such devices find application, e.g., in industrial cabinets or in residential installations.

BACKGROUND

Such a low-voltage cable connector, specifically a connector terminal, is known from the published patent application DE 198 35 459 A1. That connector terminal is an insulation displacement connector (IDC), i.e, a connector that does not require stripping of a cable insulation prior to making the connection. The IDC comprises an insulating housing, into which an end of a cable having an inner conductor and an outer insulation can be inserted. By inserting the cable a locking mechanism is opened, which thereupon releases an insertion spring. The released spring then pushes a guiding means in such a way that the cable is pushed by the guiding means into a cutting contacting element, which cuts through the cable insulation and electrically contacts the conducor of the cable. This way, a substantially operator-independent contact can be realized, i.e., the contact made to the cable conductor hardly depends on the person operating the IDC. The spring keeps the cable in place.

Disadvantageously, a rather strong and therefore large spring is required in order to enable the IDC to cut standard cable insulations. This leads to an undesireably large IDC. Furthermore, the IDC has the danger of not well-defined and therefore insecure contacts, because the proper choice of the spring is very delicate and requires large safety margins, in particular if different types of cables and cables of different diameter shall be dealt with. If the force exerted by the spring on the cable is too small, the cable insulation may not be cut, so that no contact will be made, whereas if the force exerted by the spring is too large, the cable conductor may be damaged, even broken.

SUMMARY OF THE INVENTION

Therefore, the goal of the invention is to create an electrical cable connector that does not have the disadvantages mentioned above. An operator-independent connector terminal, and in particular an insulation displacement connector (IDC), shall be provided, which can be small in dimension and allows to securely make contact with cables of various properties. In addition, the respective method for contacting a cable and a connector terminal block shall be provided.

The problem is solved by apparatusses and a method with the characteristics of the claims.

According to the invention, the cable connector for making an electrical contact with a cable having a cable conductor comprises a guiding means for receiving one end of the cable in an initial state, a contact element for electrically contacting the cable conductor in a final state, and a holding means for holding the cable in electrical contact with the contact element in the final state, wherein the guiding means and the contact element are moveable relative to each other, allowing for movements between the initial state and the final state.

It is characterized in that a spring device is provided, which is arranged such that it exerts a force against the movement from the initial state to the final state, and that the spring device moves the cable towards the initial state if the cable is not in the final state.

Through this, an operator-independent contact can be realized, i.e. the quality of the connection is independent of an operator, even when the operator works under time pressure or with reduced attention. In the final state, the cable is helt in contact with the contact element by the holding means. If the final state is not reached, the cable will be moved towards the initial state. Accordingly, it is possible to prevent tottering contacts or loose contacts. Unsafe contacts and contacts of questionable quality are avoided, since either a safe contact exists or the cable is moved away from the contact element. In addition, an operator operating the cable connector will be able to see that the cable is not in the final state, in which final state a safe electrical contact between cable conductor and contact element is provided for. Accordingly, it is easily detectable if the cable connector has not been operated properly. This saves much time and effort, in particular if a large number of cable connectors are worked on, since it is obvious, which cable connectors have to be reworked.

In the final, closed state the cable is kept in contact with the contact element by the holding means, whereas if the final state is not reached, the spring device will move the cable towards the initial, open state, i.e., the cable is rejected. The movement between initial and final state always concerns the cable, in so far as it is brought into contact or out of contact with the contact element. The cable may be fixed in space or relative to a housing, or it may be moved while changing between initial and final state. It is possible to move the guiding means and/or to move the contact element in order to change between initial and final state.

The cable can be an insulated cable or a cable without an insulation. The cable conductor may be solid or stranded. The holding means can, e.g., work through clamping. It can hold the cable, e.g., through friction or through force.

The spring device may, e.g., comprise a flat spring or a helical spring. Since the spring device rejects the cable if the final state is not reached, the spring device can be said to comprise a rejection spring.

It is possible to ensure a safe contact in the final state by intensifying the action of the holding means in the final state. This is one possibility to implement a contact ensuring mechanism. But preferably, a contact ensuring mechanism is provided, which in the final state reduces the force exerted by the spring device against the movement from the initial state to the final state. Through this, a safe contact in the final state is ensured. A reduced force of the spring pushing or pulling the cable out of contact with the contact element in the final state will improve the capability of the holding mechanism to hold the cable in contact with the contact element in the final state, hence ensuring a safe contact. The contact ensuring mechanism also relaxes the design requirements when the cable connector shall deal with a wide variety of cables, in particular of various cable conductor diameters.

In a preferred embodiment the contact ensuring mechanism reduces the force exerted by the spring device against the movement from the initial state to the final state to zero. This ensures a very safe contact. Usually the spring device will be the source of the only force or at least of the by far greatest force acting towards the initial state. So, if this force is inhibited by the contact ensuring mechanism, the holding mechanism easily ensures a safe contact in the final state. The contact ensuring mechanism can preferably be a locking mechanism for the action of the spring, which comes into force in the final state or even defines that the final state is reached through its activation.

In another preferred embodiment an opening mechanism is provided for terminating the reduction of the force exerted by the spring device against the movement from the initial state to the final state i.e. the opening mechanism undoes the action of the contact ensuring mechanism. That way, it is possible to let the spring device act again or act stronger again, so as to support or to invoke a release of the cable from the contact element.

In another preferred embodiment the spring device moves the cable into the initial state if the cable is not in the final state. This has the advantage that a very clear indication is provided in case the final state, and therefore a safe contact, has not been reached. The cable is back in the initial state in that case, which also eases to rework the cable connection.

In another preferred embodiment the holding means and the contact element are comprised in a clamping contacting element. Clamping connections can provide for both, realizing the contact to the cable conductor and holding that contact, in an efficient way.

In another preferred embodiment the spring device comprises the contact ensuring mechanism. This allows to make the cable connector compact.

In another preferred embodiment the spring device comprises the opening mechanism. This allows to make the cable connector compact. Especially preferred is a cable connector with a spring device comprising the opening mechanism and the contact ensuring mechanism.

Preferably, the spring device is a leaf spring made from resilient material. Such spring devices allow for sufficiently high forces, while being small in dimensions.

In a very preferred embodiment the cable connector is an insulation displacement contact (IDC) for making an electrical contact with a cable having a cable conductor and a cable insulation, comprising a cutting element for cutting through the cable insulation. No cable stripping is necessary before electrically contacting the cable in case of such a cable connector.

In a preferred embodiment of that very preferred embodiment a cutting clamping connector is provided, which comprises the holding means, the cutting element and the contact element. This allows for a very compact IDC.

A connector terminal block according to the invention is characterized in that it comprises at least one cable connector according to the invention. The advantages of the connector terminal block are the corresponding advantages of the insulation displacement connector.

Preferably, such a connector terminal block comprises an electrically insulating housing accommodating the at least one cable connector, and further comprising an electrically conductive interconnection element for electrically connecting at least one insulation displacement connector to another electric device. That other electric device will oftentimes be another cable connector, e.g., an IDC as described above.

The method for electrically contacting a cable having a cable conductor comprises the steps of:

inserting one end of the cable into a guiding means in an initial state, carrying out a relative movement of the guiding means and a contact element, thereby changing from the initial state towards a final state, in which final state the cable conductor is in electrical contact with the contact element.

It is characterized in that through carrying out the relative movement a force is applied against a spring device, which spring device is arranged to act against the relative movement, and that the cable is moved towards the initial state by the spring device if the cable is not in the final state.

In a preferred method the action of the spring device against the relative movement is inhibited by a contact ensuring mechanism.

In another preferred method the cable has a cable insulation, and the relative movement comprises a relative movement of the guiding means and a cutting element, and the method comprises the step of cutting through the cable insulation by means of the cutting element.

The advantages of the methods correspond to the advantages of the cable connector.

A person operating a cable connector according to the invention shall be able to sense when the final state is reached. This can be realized, e.g., through the spring device or through an additional indicator. The sensing can preferably be tactile, optical and/or acoustic.

Further preferred embodiments and advantages emerge from the dependent claims and the figures.

BRIEF DESCRIPTION OF THE DRAWINGS

Below, the invention is illustrated in more detail by means of preferred embodiments, which are shown in the included drawings. The figures show.

The reference symbols used in the figures and their meaning are summarized in the list of reference symbols. Generally, alike or alike-functioning parts are given the same reference symbols. The described embodiments are meant as examples and shall not confine the invention.

DETAILED DESCRIPTION OF THE PREFERRED EMBODIMENTS

Figure 1:
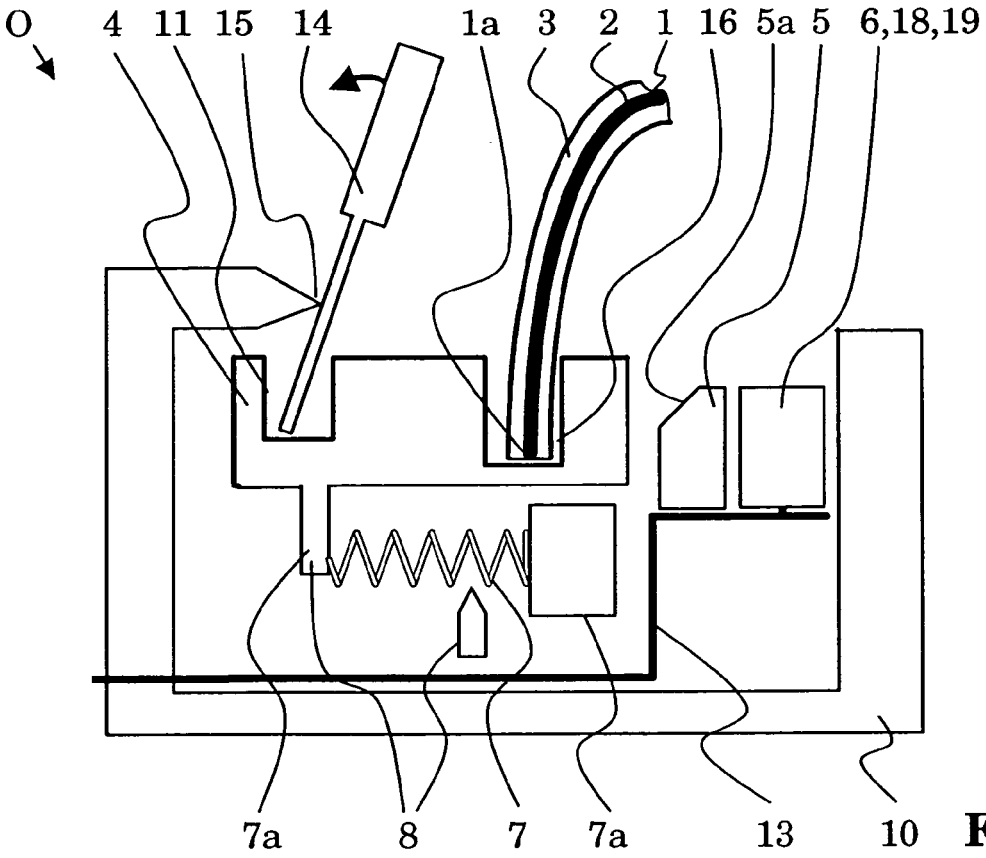
FIG. 1 a schematic side view of an insulation displacement connector (IDC) according to the invention in a initial state.

FIG. 1 schematically shows an isulation displacement connector (IDC) according to the invention in an initial state O. The task of this connector terminal is to electrically contact a cable 1, which has a cable conductor 2 and a cable insulation 3. The IDC comprises a guiding means 4 for receiving an end 1*a* of the cable 1 and for moving the end 1*a* of the cable 1 into a cutting element 5 and a clamping contacting element 19. The clamping contacting element 19 incorporates the functions of a contact element 6, which is to electrically contact the cable conductor 2, and a holding means 18, which shall hold the cable conductor 2 in electrical contact with the contact element 6, in this case by clamping. The cutting element 5 cuts through the cable insulation 3 by means of its cutting edge 5*a*, so that the contact element 6 can electrically contact the cable conductor 2. The contact element 6 is in electrical contact with an electrically conductive interconnection element 13 in order to provide an electrical connection to another electrical device. e.g., another IDC.

An operator provides the force necessary for moving the guiding element 4 with the cable end 1*a* and for cutting the insulation 3 and for contacting the cable conductor 2. A tool 14, e.g., a standard tool like a screw-driver, can be used by the operator in order to move the guiding means 4, preferably in lever action, as indicated in FIG. 1. Therefore, the guiding means 4 has as a force receiving means 11 an opening 17 for the tool 14. A pivotal point 15 for the lever action is in FIG. 1 provided by a housing 10 of the IDC. The arrow indicates how the tool 14 is moved when the IDC is operated. The tool 14 could, for example, also be moved laterally and sliding instead of in lever action for moving the guiding means 4.

When the IDC is to be operated, the cable 1 is inserted into a cable receiving opening 16 of the guiding means 4, and the tool 14 is entered into the force receiving means 11. When then the guiding means 4 is moved, extra force has to be applied in order to act against a spring device 7, which in FIG. 1 is illustrated as a coil spring 7, which is held between two spring holders 7*a*, 7*b*. Spring holder 7*a* is integrated in the guiding means 4 and spring holder 7*b* is fixed to the housing (not shown in FIG. 1). After the guiding means 4 has been moved over a certain length and the cable conductor 2 contacts the contact element 6, a locking mechanism 8 will terminate the action of the spring device 7. In FIG. 1 the locking mechanism 8 is provided by the guiding means 4 together with an elastically helt tip 8. When the locking mechanism 8 is activated, the cable 1 is in safe contact with the contact element 6 because of the holding means 18.

In this final, contacting state (not shown in FIG. 1), the force exerted on the guiding means 4 and the cable 1 by the spring 7 is zero or at least greatly reduced. The operator will feel and maybe hear the activation of the locking mechanism 8. If the operator would terminate his action before the activation of the locking mechanism 8, the spring 7 would act so as to push back the guiding means 4 and the cable 1 towards or preferably into the initial state. A situation in which there is no contact between the cable conductor 2 and the contact element 6 is therefore easily visible, and bad contacts are impossible to come about and are therefore successfully avoidable if the spring device and the locking mechanism are designed and arranged suitably.

Figure 2:
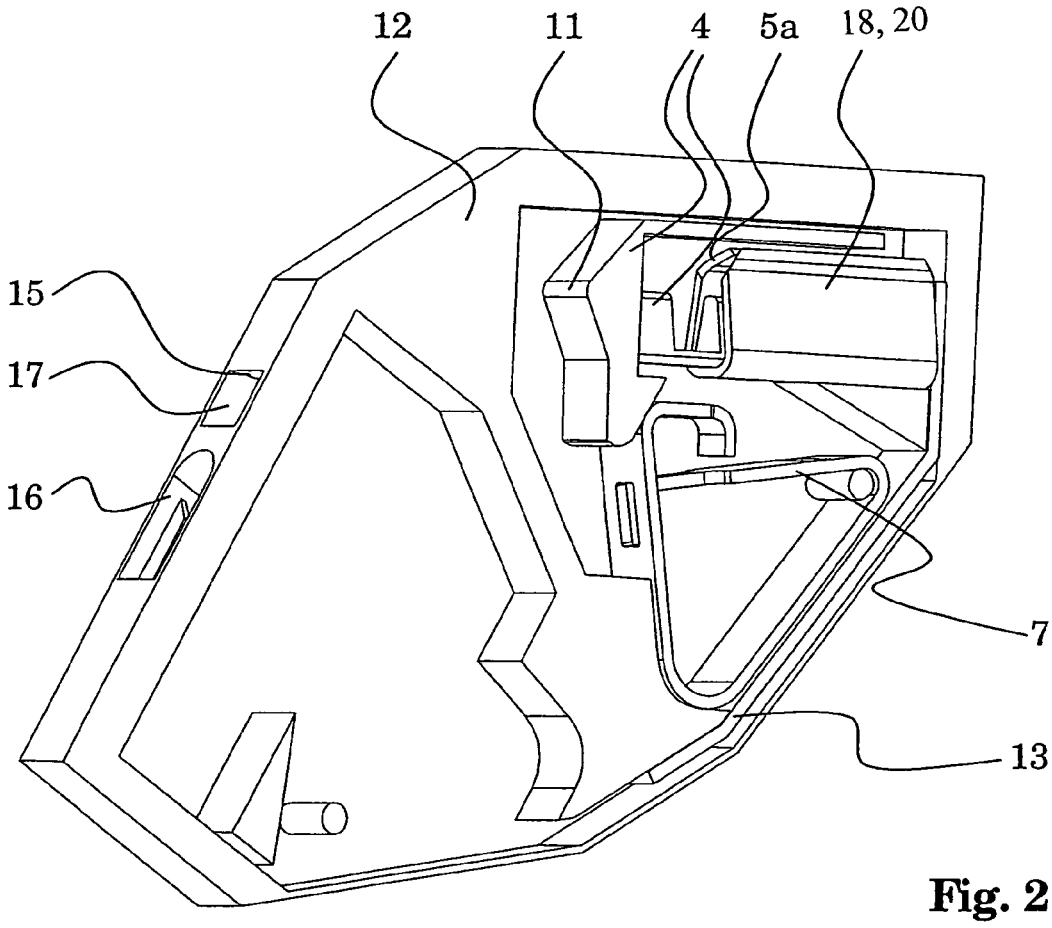
FIG. 2 a perspective view of a partially disassembled connector terminal block, partially schematic.

FIG. 2 shows a perspective view of a connector terminal block meant for two IDCs and comprising one IDC according to the invention. For reasons of clarity, the left side of the connector terminal block is illustrated in a state not equipped with an IDC. A housing 12 of the connector terminal block comprises the tool insertion opening 17, which also provides for the pivotal point 15 for a lever action of an inserted tool. The housing 12 also comprises the cable insertion opening 16. The spring device 7 is a leaf spring, preferably made from spring steel, which comprises the locking mechanism and, in addition, an opening mechanism. More details on such spring devices 7 are shown in FIGS. 3*a*–3*e*; see also the discussion in conjunction FIGS. 3*a*–3*e*.

In the IDC shown in FIG. 2 the guiding means 4 and the end 1*a* of the cable is moved with respect to the housing 12. The guiding means 4 can be made in a single piece from a polymer material. The IDC comprises a culling clamping connector 20, which unites the function of the cutting element 5 and the contact element 6 and a holding means 18. The cutting clamping connector 20 can be formed from one piece of metal. At the end of the cutting clamping connector 20 opposite to the culling edge 5*a*, the cutting clamping connector 20 is electrically connected to the electrically conductive interconnection element 13, which preferably is a piece of sheet metal. When both sides of the cutting clamping connector 20 are equipped with IDCs, one single piece of metal can be used as the electrically conductive interconnection element 13 for connecting the two IDCs with each other.

FIGS. 3*a* to 3*e* show a spring device 7 similar to that shown in FIG. 2 in various states. This kind of spring device can also be used in other applications, not only in electric devices and not only in connector terminals. The spring device 7 shown in FIGS. 3*a*–3*e* combines a spring function, a locking mechanism 8 and an opening mechanism 9 in one device, which can be made in one piece. It can be made from a resilient material, e.g., from a metal, like spring steel, or, if less force is sufficient, from polymer material.

FIGS. 3*a*–3*d* show, how the spring device 7 deforms when it is incorporated in a cable connection device like the one of FIG. 2, while the cable moves from the initial state to the desired final state.

Figure 3A:
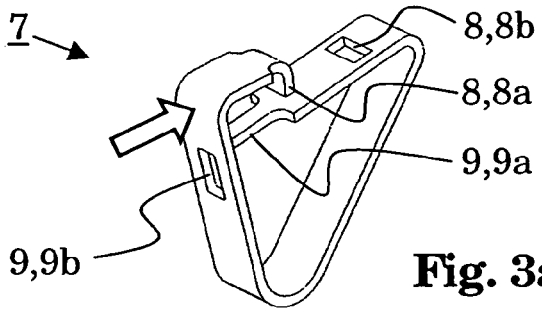
FIGS. 3*a*–3*e* a perspective view of a spring device comprising a locking mechanism and an opening mechanism, shown in various states.
Figure 3B:
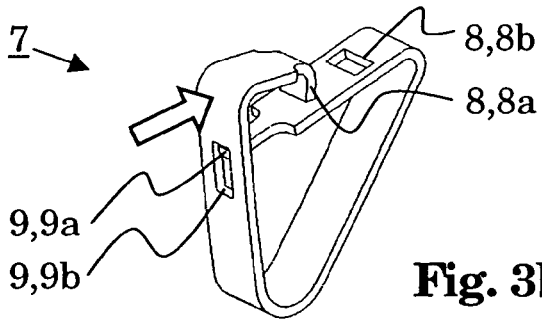
Figure 3C:
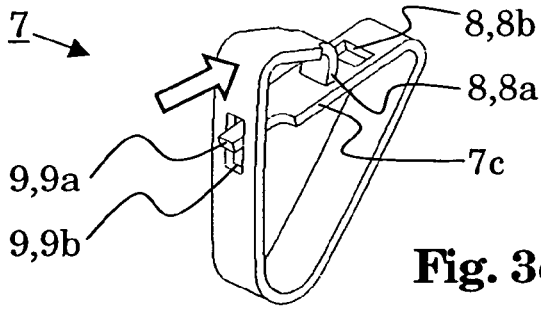
Figure 3D:
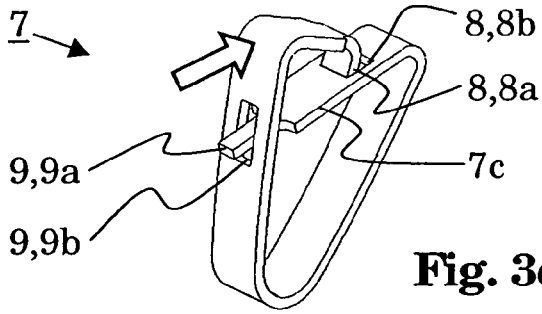

The outlined arrow shows a preferred point and direction of application of a force exerted on the spring 7. The locking mechanism 8 comprises a jut 8*a* and an opening 8*b*, which will work together so as to lock the spring device 7 as shown in FIG. 3*d*, e.g., when the final state is reached.

Figure 3E:
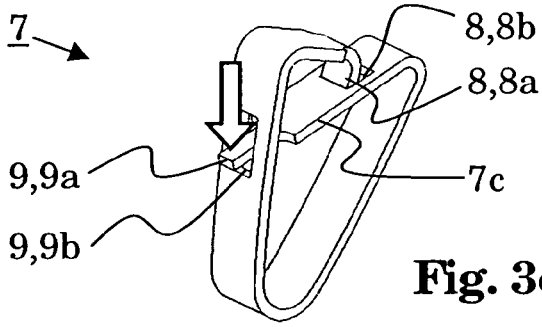

FIG. 3*e* illustrates the function of the opening mechanism 9, which is incorporated in the spring device 7. Pressing along the direction of the outlined arrow onto the jut 9*a*, which is located in an opening 9*b* for better accessibility, will deactivate (open) the locking mechanism 8. The pressing will lower the arm 7*c* of the spring device 7, so that the jut 8*a* can leave the opening 8*b*, and the spring device 7 will return to the initial state shown in FIG. 3*a*.

In order to achieve higher forces with a spring device 7 like shown in FIGS. 3*a*–3*e*, the space surounded by the arms (sides) of the spring device 7 can be filled with a resilient material, e.g., a polymer foam.

Figure 4:
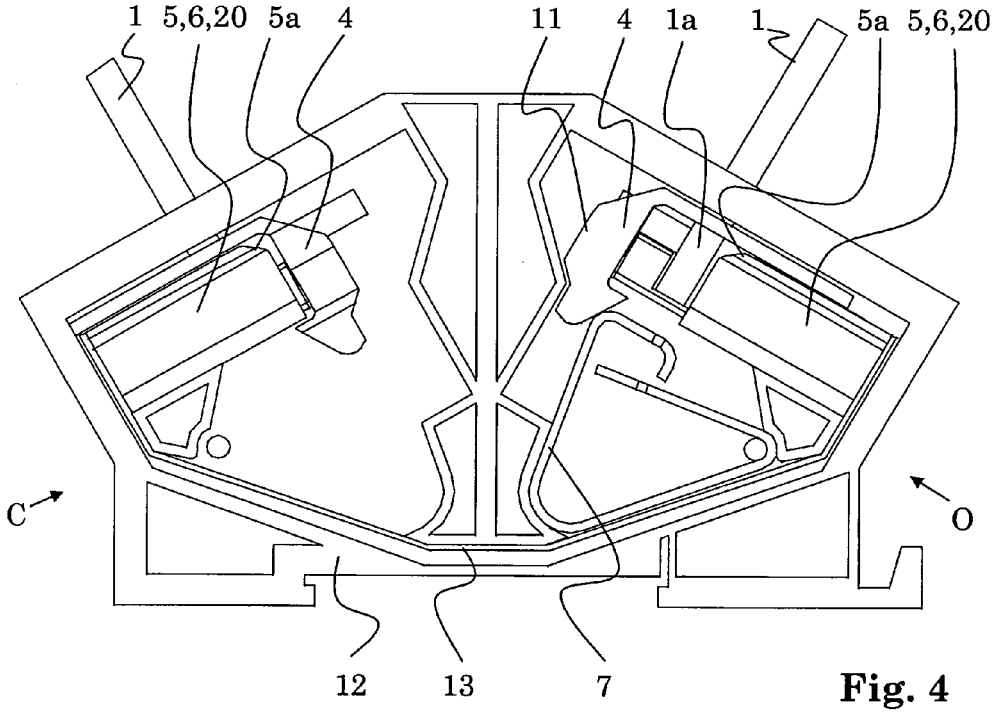
FIG. 4 a side view of a connector terminal block with two IDCs, one shown without spring device, partially schematic.

FIG. 4 shows a side view of a connector terminal block similar to the one shown in FIG. 2. Mainly, the housing 12 is different, and each of the halves of the connector terminal block are equipped with one IDC according to the invention. The right half shows the IDC in the initial state O (open), in which the insulated cable 1 is inserted. The left half shows the IDC in the desired final state C (closed), in which a safe contact between cable conductor and contact element 6 is provided. The IDC on the left side is drawn without spring device 7.

The cutting clamping connector 20 and the spring device 7 are dimensioned and arranged such that the force exerted by the spring device 7 on the guiding means 4, which is carrying the cable 1, is greater than a holding or clamping force exerted on the cable 1 by the cutting clamping connector 20 at any time before the final state C is reached. Accordingly, the cable 1 will be moved towards, preferably into, the initial state O if an operator stops moving the cable between initial and final state before the final state C is reached. If the guiding means 4 has been moved sufficiently far for reaching the final state C and then the operator terminates the movement, the spring device 7 will be fixed in the final state C by the locking mechanism 8, so that the cable is safely fixed in the cutting clamping connector 20 in the final state, with no force being exerted on the cable 1 by the spring device 7.

The locking mechanism 8 is a special embodiment of a contact ensuring mechanism 8. A contact ensuring mechanism 8 reduces the force exerted by the spring device 7 against the movement from the initial state O to the final state C, but not necessarily to zero. If the IDC is not equipped with a contact ensuring mechanism 8, it shall be assured that in the final state C the holding means (in FIG. 4 incorporated in the cutting clamping connector 20) holds the cable 1 such that the spring means 7 cannot remove the cable from the final state C.

There are various ways to indicate to the operator that he can terminate his action, because the final state C has been reached. In FIG. 4, for example, the guiding means 4 will touch the housing 12, when the operator has moved the guiding means 4 and the cable far enough. Accordingly, there is a rapid increase in resistance to the operator's action, indicating that he has pushed far enough. Also, a change in resistance to the operator's action will occur as soon as the jut 8*a* touches the arm 7*c* of the spring device 7 (see FIG. 3*c*) and slides on that arm 7*c*. This can indicate to the operator that he will soon have moved the guiding means 4 and the cable 1 far enough. A sound and a change in resistance to the operator's action will occur as soon as the jut 8*a* enters the opening 8*b* (see FIGS. 3*c*–3*d*). This can be used as an indicator that the operator's action is just sufficient to reach the final state C. Various other indicators are possible and known from the literature.

But, more importantly, it will be visible when a cable is not in the desired final state C, since the spring device 7 will move the cable 1 towards the initial state O if the cable is not in the final state C; even without a contact ensuring mechanism 8. And no imperfect contact can occur.

The cutting clamping connector 20 in FIGS. 2 and 4 are known as "U-shaped". Certainly, also so-called "V-shaped" connectors can be used. The latter are typically substantially a flat piece of metal with an approximately triangular slit. V-shaped devices can, of course. also be used as cutting elements 5 and as clamping contact elements 6. Furthermore, the cutting element 5 does not need to be symmetric.

In most applications for the cable connectors according to the invention there will be pull-out requirements, which are meant to ensure that the cable remains in the cable connector. These requirements can be met by the holding means. But an additional means can also be provided for that purpose.

The guiding means 4 can also provide for a contact ensuring mechanism 8, instead of the spring device 7 (FIGS. 2 and 4). Also the (IDC) contact itself or the combined arrangement of the contact and the rejection spring can provide for a contact insuring mechanism.

The guiding means 4 can also be a part of a housing 10 or 12, in which case the contact element 5 will have to move relative to the housing 10 or 12 in order to change between initial and final state.

As shown in U.S. Pat. No. 6,183,288 it is also possible to have one item in the cable connector, which unites the functions of a spring device 7 with the funtions of a cutting clamping connector.

Force receiving means 11 can, e.g., be openings, slits or knobs. They can be provided for in the guiding means 4, if this is to be moved, or in the contact element 6, if that is to be moved towards the guiding means 4 and the cable 1 (and relative to the housing).

An opening mechanism can be designed such that it is activated manually or that a tool shall be used to activate it. The devices in FIGS. 2 and 4 require a tool, like a rod or a screw-driver, for activating the opening mechanism.

The devices according to the invention ensure that if the operator finishes the insertion movement prematurely, the cable 1 will be rejected, which will easily be noted by the operator. There will be no connections of questionable quality, since it is obvious to the operator, which cable connectors need to be reworked, since the respective cable is rejected by the spring device 7. An opening mechanism (release mechanism) can be provided, which unlocks a locking mechanism 8 (or undoes the action of a contact ensuring mechanism) and partially removes the cable towards the initial state or ejects the cable.

LIST OF REFERENCE SYMBOLS

1 cable
1*a* end of cable
2 cable conductor
3 cable insulation
4 guiding means
5 cutting element
5*a* cutting edge
6 contact element
7 spring device, spring
7*a*,7*b* spring holder
7*c* arm of the spring
8 contact ensuring mechanism, locking mechanism
8*a* jut
8*b* opening
9 opening mechanism
9*a* jut
9*b* opening
10 housing (of cable connector), insulating housing
11 force receiving means, opening
12 housing (of connector terminal block)
13 electrically conductive interconnection element (current bar)
14 tool
15 pivotal point
16 cable insertion opening
17 tool insertion opening
18 holding means
19 clamping contacting element
20 cutting clamping connector
O initial state, open
C final state, closed

The invention claimed is:

1. Cable connector for making an electrical contact with a cable having a cable conductor, comprising:

a guiding means for receiving one end of the cable in an initial state;

a contact element for electrically contacting the cable conductor in a final state; and a holding means for holding the cable in electrical contact with the contact element in the final state, wherein the guiding means and the contact element are moveable relative to each other, allowing for movements between the initial state and the final state, wherein a spring device is provided which is arranged such that it exerts a force against the movement from the initial state to the final state, and which moves the cable towards the initial state if the cable is not in the final state and wherein a contact ensuring mechanism is provided, which in the final state reduces the force exerted by the spring device against the movement from the initial state to the final state.

2. Cable connector according to claim 1, wherein the contact ensuring mechanism reduces the force exerted by the spring device against the movement from the initial state to the final state to zero.

3. Cable connector according to claim 2, wherein an opening mechanism is provided for terminating the reduction of the force exerted by the spring device against the movement from the initial state to the final state.

4. Cable connector according to claim 1, wherein the holding means and the contact element are comprised in a clamping contacting element.

5. Cable connector according to claim 1, wherein the spring device comprises an contact ensuring mechanism.

6. Cable connector according to claim 1, wherein the spring device comprises an opening mechanism.

7. Cable connector according to claim 1, for making an electrical contact with a cable having a cable conductor and a cable insulation, comprising a cutting element for cutting through the cable insulation.

8. Cable connector according to claim 7, wherein a cutting clamping connector is provided, which comprises the holding means, the cutting element and the contact element.

9. Connector terminal block, wherein it comprises at least one cable connector according to claim 1.

10. A connector terminal block according to claim 9, further comprising an electrically insulating housing accommodating the at least one cable connector, and further comprising an electrically conductive interconnection element for electrically connecting at least one insulation displacement connector to another electric device.

11. Method for electrically contacting a cable having a cable conductor, comprising the steps of:

inserting one end of the cable into a guiding means in an initial state, carrying out a relative movement of the guiding means and a contact element, thereby changing from the initial state towards a final state, in which final state the cable conductor is in electrical contact with the contact element, wherein that through carrying out the relative movement a force is applied against a spring device, which spring device is arranged to act against the relative movement, that the cable is moved towards the initial state by the spring device if the cable is not in the final state and wherein in the final state the action of the spring device against the relative movement is inhibited by a contact ensuring mechanism.

12. Method according to claim 11, wherein the cable has a cable insulation, and wherein the relative movement comprises a relative movement of the guiding means and a cutting element, and comprising the step of cutting through the cable insulation by means of the cutting element.

* * * * *